US008430266B2

(12) United States Patent
Barton

(10) Patent No.: US 8,430,266 B2
(45) **Date of Patent: *Apr. 30, 2013**

(54) FLEXIBLE CONTAINER WITH INTEGRAL DISPENSING TUBE

(71) Applicant: Lewis Barton, New York, NY (US)

(72) Inventor: Lewis Barton, New York, NY (US)

(73) Assignee: Barton Group, Inc., East Hampton, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/673,594

(22) Filed: Nov. 9, 2012

(65) Prior Publication Data

US 2013/0062365 A1 Mar. 14, 2013

Related U.S. Application Data

(63) Continuation of application No. 13/101,880, filed on May 5, 2011, now Pat. No. 8,381,941.

(51) Int. Cl.
*B65D 25/00* (2006.01)
*B65D 90/00* (2006.01)

(52) U.S. Cl.
USPC ..... 220/694; 220/505; 206/484

(58) Field of Classification Search ..... 220/23.8, 220/501, 505, 575, 761, 694; 206/532, 484, 206/820
See application file for complete search history.

(56) References Cited

U.S. PATENT DOCUMENTS

| | | | |
|---|---|---|---|
| 3,640,430 | A | 2/1972 | Roberts |
| 3,908,864 | A | 9/1975 | Capper |
| 3,913,734 | A | 10/1975 | Siegel |
| 3,940,018 | A | 2/1976 | Scholle |
| 4,069,951 | A | 1/1978 | Von Winckelmann |
| 4,314,654 | A | 2/1982 | Gaubert |
| 4,322,018 | A | 3/1982 | Rutter |
| 4,416,395 | A | 11/1983 | Gaubert |
| 4,491,245 | A | 1/1985 | Jamison |
| 4,491,247 | A | 1/1985 | Nitchman et al. |
| 4,491,250 | A | 1/1985 | Liebermann |
| 4,838,429 | A | 6/1989 | Fabisiewicz et al. |
| 4,871,091 | A | 10/1989 | Preziosi |
| 4,949,878 | A | 8/1990 | Jacobi |
| 5,104,002 | A | 4/1992 | Cahlander et al. |
| 5,203,459 | A | 4/1993 | Wade |
| 5,356,039 | A | 10/1994 | Christine et al. |
| 5,411,178 | A | 5/1995 | Roders et al. |
| 5,632,416 | A | 5/1997 | Lane, Jr. et al. |
| 5,647,511 | A | 7/1997 | Bond |

(Continued)

FOREIGN PATENT DOCUMENTS

FR 2801283 A1 11/1999

*Primary Examiner* — Harry Grosso
(74) *Attorney, Agent, or Firm* — Ableman, Frayne & Schwab

(57) ABSTRACT

A package for containing a viscous substance in a transport configuration and for dispensing the viscous substance in a dispensing configuration is disclosed. The package includes first and second sheets disposed in opposing relation that are sealed together around a perimeter. The package has a compartment that defines a space for holding the viscous substance. The package further includes an integral tube having a first end in fluid communication with the compartment, and a second end that is closed in the transport configuration. The second end can be opened such that the viscous substance contained in the package can flow from the container, through the integral tube, and exit the package via the opening. The second end of the integral tube is positionable independent of the compartment for depositing the substance at multiple, spaced apart target locations without moving the compartment.

10 Claims, 4 Drawing Sheets

U.S. PATENT DOCUMENTS

| | | | |
|---|---|---|---|
| 5,735,423 | A | 4/1998 | Black |
| 5,931,345 | A | 8/1999 | Lane, Jr. et al. |
| 6,094,886 | A | 8/2000 | Poignant |
| 6,196,420 | B1 | 3/2001 | Gutierrez et al. |
| 6,561,383 | B1 | 5/2003 | Reddy et al. |
| 6,620,436 | B1 | 9/2003 | Rolf |
| 6,624,130 | B2 | 9/2003 | Giblin et al. |
| 6,651,848 | B1 | 11/2003 | Redmond |
| 6,883,683 | B1 | 4/2005 | Cunningham et al. |
| 7,021,495 | B2 | 4/2006 | De Laforcade |
| 7,334,702 | B2 | 2/2008 | Cunningham et al. |
| 7,690,555 | B2 | 4/2010 | Churvis et al. |
| 8,141,709 | B2 | 3/2012 | Klaus |
| 2003/0029884 | A1 | 2/2003 | Rau |
| 2003/0231808 | A1 | 12/2003 | Machacek et al. |
| 2007/0228073 | A1 | 10/2007 | Mazzarino |
| 2007/0231431 | A1 | 10/2007 | Roche et al. |
| 2010/0086239 | A1 | 4/2010 | Latour |

FLEXIBLE CONTAINER WITH INTEGRAL DISPENSING TUBE

FIELD OF THE INVENTION

The present invention concerns a package for a viscous substance. More particularly, the invention concerns a package for a viscous substance that includes an integral tube for dispensing the substance.

BACKGROUND OF THE INVENTION

The restaurant and food service industry is a large volume consumer of viscous condiments and ingredients that are used to prepare and/or accompany food items. Fast-food restaurants prepare hundreds of food items each day. Many of these food items require the application of some type of condiment or sauce. For example, many sandwiches that are made at fast-food type restaurants require the application of ketchup, mustard, mayonnaise, barbeque sauce, tartar sauce, sour cream, cheese sauce, or various combinations of these sauces, to name just a few. Often times the sauces are stored in a squeeze bottle and are applied as needed by squeezing the squeeze bottle. Other systems use a caulking-gun type dispenser in which sauce is stored in a cylinder that has a piston in the rear of the cylinder. Sauce is dispensed from the gun by pressing a trigger that moves the cylinder and causes the sauce to dispense.

These types of systems have several drawbacks. First, these can be characterized as hand-held systems in that the condiment reservoir is entirely supported by the user when these devices are used to dispense condiments. In the case of the squeeze bottle, the users must move the entire bottle to the location in which the sauce is to be dispensed (e.g., to a spot on a workstation in which a sandwich is being assembled), support the bottle, and manipulate the bottle so that it dispenses the condiment contained therein. Similarly, in the case of the gun-type dispenser, the entire gun, which includes the entire condiment reservoir, is moved, supported and manipulated by the user. Since the entire condiment reservoir must be supported by the user, the size of the reservoir is limited because if the reservoir is too large, the weight of the condiment in the reservoir will be prohibitive and can cause injury to workers that must repeatedly handle such heavy tools.

A second drawback is that since the condiment reservoirs of these devices are limited in size, the reservoirs must be replenished frequently. Their small size limits their capacity. In many applications, particularly in fast-food type restaurants, large volumes of condiments must be used everyday. Accordingly, production must be stopped frequently in order to replenish the condiment reservoirs. This is both time-consuming and labor intensive and thus makes these devices inefficient.

A third shortcoming of these devices is that the reservoir itself is a relatively expensive piece of equipment. The squeeze bottle and the cylinder of the gun-type dispenser are not considered disposable items because of their relative cost. Accordingly, when these devices exhaust their condiment reservoirs they must be refilled. The need to refill these reservoirs, as opposed to replacing the empty reservoirs with new ones that are pre-filled with condiment, further increases the inefficiency of these devices.

In addition to providing condiments and other viscous ingredients to foods in the preparation process, there are other instances where it is necessary to dispense condiments. For example, many restaurants utilize bottles of condiments that are either used by patrons at tables or used by employees during the preparation of foods. These bottles are relatively expensive and not disposable items, so they must be refilled when they are empty. Typically, these bottles are refilled from high volume packages that contain on the order of three to five gallons of condiment. These high volume packages usually are plastic bags that included fitments, much like the package described in U.S. Pat. No. 5,647,511 to Bond. In order to dispense the condiment from these packages, a separate nozzle must be inserted into the fitment.

These high volume packages have several disadvantages. First, having to include a rigid fitment into the bag greatly increases the material cost and manufacturing difficulty of the package. Second, inserting a nozzle into the fitment can be a difficult procedure that can result in spillage of condiment from the package that will need to be cleaned and can create unsanitary conditions for the dispensing of the condiment.

The present invention addresses these and other problems.

SUMMARY OF THE INVENTION

According to one aspect of the invention, a package for containing a viscous substance in a transport configuration, and for dispensing the viscous substance in a dispensing configuration, is provided. The package includes a first sheet having a first thickness. A second sheet is disposed in opposing relation to the first sheet and has a second thickness. The second sheet has one or more deformed portions that has a third thickness that is less than the first thickness and which is less than the second thickness. A seal extends around the perimeter of the first and second sheets and defines first and second sections. A compartment is defined within the perimeter and between the first section of the first and second sheets. The compartment has a compartment length, a compartment width, and a compartment depth. An integral tube is defined by the second section. The integral tube has a tube length greater than or equal to the compartment length, and a tube width and a tube depth less than the compartment width and the compartment depth. The integral tube has a first end in fluid communication with the compartment. The second end of the integral tube is closed in the transport configuration. In the dispensing configuration, the second end of the integral tube defines an opening such that the viscous substance contained in the package can flow from the container, through the integral tube, and exit the package via the opening. The second end of the integral tube is positionable independently of the compartment such that the viscous substance that exits the package via the opening can be deposited at multiple, spaced-apart target locations without moving the compartment.

In a more particular, optional arrangement, in a natural state the integral tube has a generally D-shaped cross-section in which the first sheet is generally flat.

In a further arrangement, the third thickness is no less than approximately 70%-80% of the first thickness.

According to further optional arrangements, the second end of the integral tube includes tear notches, wherein a tear of the integral tube along a tear notch defines the opening.

In yet a further, possible arrangement, the seal is defined by regions of bonding of the first and second sheets together.

According to further optional arrangements, the seal includes at least one mounting hole.

In a further particular, possible arrangement, the mounting hole is positioned such that the package can be supported from the mounting hole with the integral tube extending downwardly from the compartment.

In a further arrangement, gravity assists the viscous substance contained in the package to flow from the container, through the integral tube, and exit the package via the opening.

Various features, aspects and advantages of the invention can be appreciated from the following Description of Certain Embodiments of the Invention and the accompanying Drawing Figures.

DETAILED DESCRIPTION OF CERTAIN EMBODIMENTS OF THE INVENTION

Figure 1:
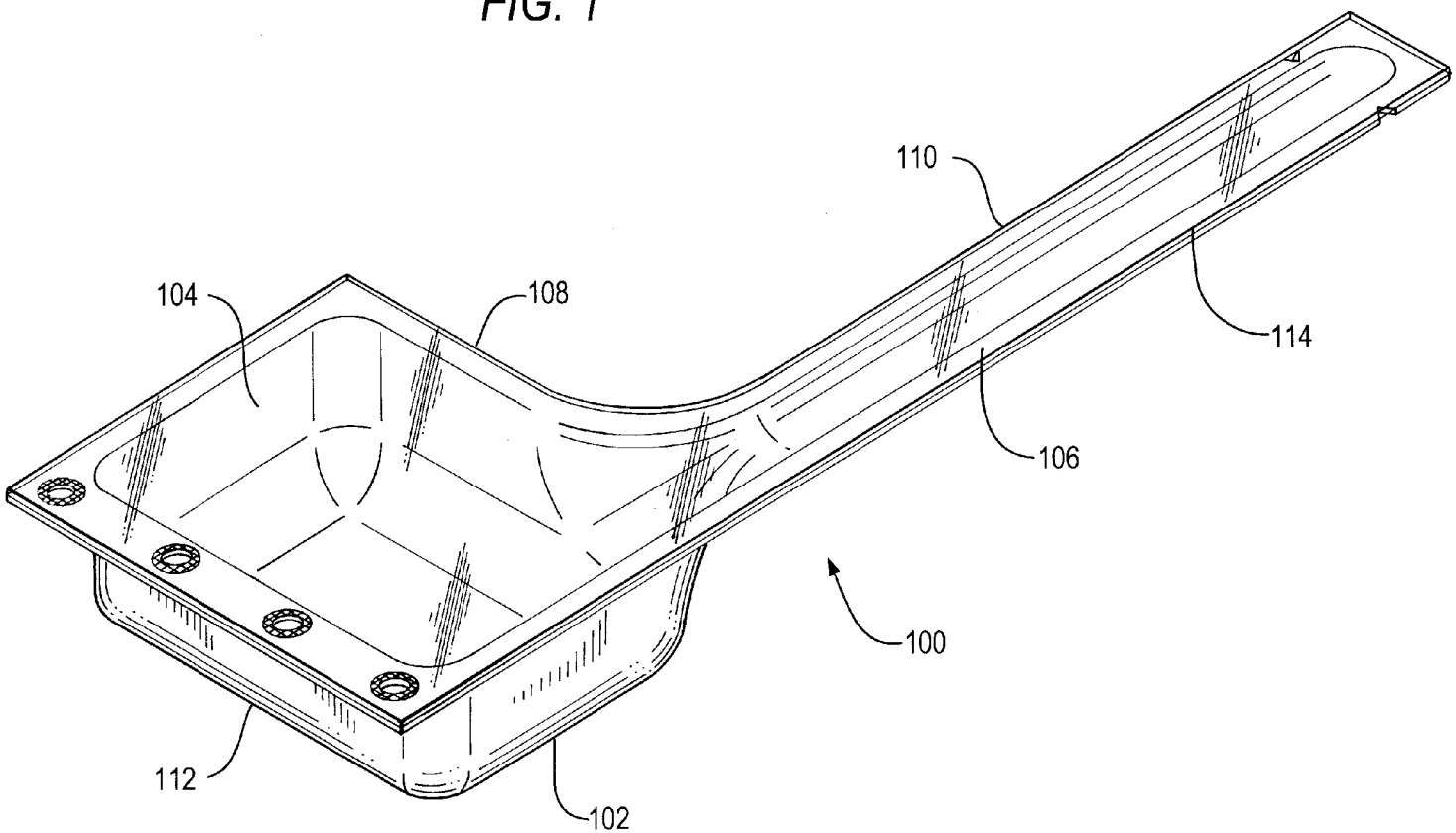
FIG. 1 is a perspective view of a package according to an embodiment of the invention.

By way of overview and introduction, the present invention is described in detail in connection with a package that is both adapted for the transport and the dispensing of condiment contained therein In one implementation, referring to FIGS. 1-3, a package 100 includes a first sheet 104 and a second sheet 102. A seal 106 extends around the perimeter of the first and second sheets 104, 102. The seal 106 defines a first section 108 of the package and a second section 110 of the package. The first section 108 defines a compartment 112 within the perimeter of the seal 106 and between the first sheet 104 and the second sheet 102. The second section 110 defines an integral tube 114 within the perimeter of the seal 106 and between the first sheet 104 and the second sheet 102.

The compartment 112 has a length "L" a width "W" and a depth "D". The compartment 112 provides a space for storing liquid or semi-liquid product (e.g., a condiment such as ketchup). The integral tube 114 has a length "l", a width "w", and a depth "d". The integral tube 114 is integral with the compartment 112 and the integral tube 114 is in fluid communication with the compartment 112. The integral tube 114 can also store an amount of the liquid or semi-liquid product. However, one of the purposes of the integral tube 114 is to provide a conduit 115 for the dispensing of the product from the compartment 112, through the integral tube 114 via the conduit 115, to the free end 118 of the integral tube 114. The free end 118 of the integral can be torn or cut open, as described in more detail below, so that the product contained in the package 110 can be dispensed via the integral tube 114. The other end 120 of the integral tube 114 is in fluid communication with the compartment 112.

The package 110 is used for bulk containment and dispensing of product. For example, the compartment 112 can be sized and shaped to hold between 2 and 5 gallons of product, and smaller and larger capacities are also contemplated. As discussed in more detail below, the first and second sheets 104, 102, are formed of a flexible plastic material. Accordingly, the integral tube 114 can be moved relative to the compartment 112 so that product being dispensed from the integral tube can be deposited at different locations by moving the free end 118 of integral tube 114. Due to the length "l" and flexibility of the integral tube 114, the free end 118 of the integral tube 114 can be moved without moving the compartment 112. Thus, a desired amount of product can be dispensed from the package 100 at multiple, spaced-apart desired locations by moving the free end 118 of the integral tube 114 while the compartment 112, which contains the bulk of the product, and is therefore heavy, is not moved. The length "l" of the integral tube 114 can be greater than or equal to the compartment length "L". This length "l" of the integral tube 114 relative to the length "L" of the compartment 112 permits the free end 118 of the integral tube 114 to be moved relatively freely without moving the compartment 112.

Figure 3:
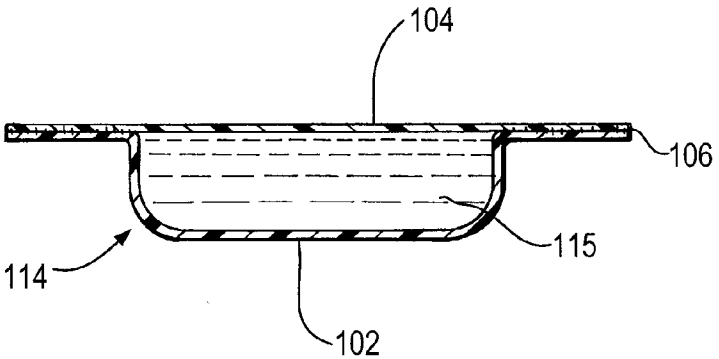
FIG. 3 is a cross-section view along A-A of the integral tube of the package of FIG. 1.

As can be seen in FIG. 3, the integral tube 114 has a generally D-shape cross-section in a natural state (i.e., not deformed by the weight of the product disposed within the compartment 112 and integral tube 114) in which sheet 104 is generally flat and sheet 102 is deformed to form the D-shape.

Figure 4:
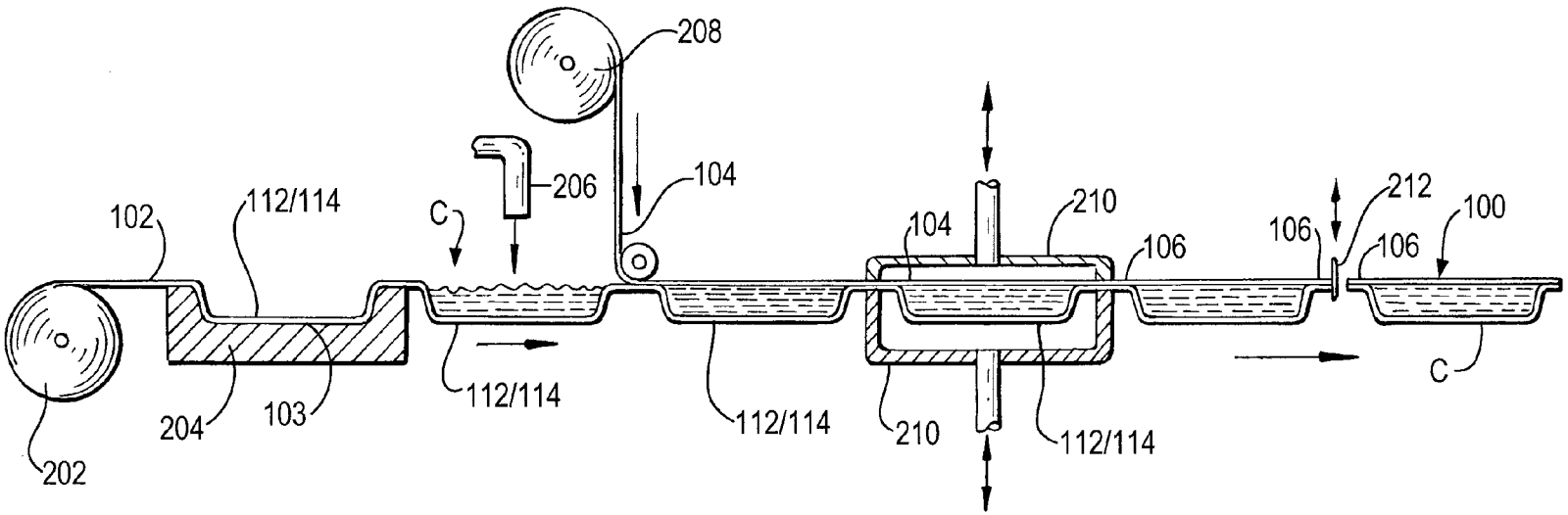
FIG. 4 is a schematic view of a horizontal form fill seal machine.

The package 100 is preferably formed on a horizontal-form-fill-seal ("HFFS") machine This HFFS process is described in more detail in U.S. Pat. No. 4,322,465, which is hereby incorporated by reference in its entirety. The HFFS process described in U.S. Pat. No. 4,322,465 is a representative process for forming a package. This general process can be specially adapted for a package 100, by specially sizing and shaping the machine to accommodate the size and shape package 100. Moreover, package 100 is filled with a liquid or semi-liquid product (e.g. condiment) and contained between sheets 104 and 102 of the package. Referring to FIG. 4, an exemplary illustration of the HFFS process for forming a package is shown. The second sheet 102 of material is stored on and spooled off of a roll 202 and is indexed to the processes of the HFFS machine The second sheet 102 is spooled over a thermoforming apparatus 204 that applies, for a duration, heat and vacuum sufficient to draw and deform the second sheet 102 into a cavity (i.e., a mold) of the thermoforming apparatus, which is sized and shaped to create the compartment 112 and the integral tube 114. Accordingly, the compartment 112 and the integral tube 114 are formed by the thermoforming deformation of sheet 102. Additionally, since the compartment 112 and the integral tube 114 are formed from the same sheet 102, they are integrally connected so that the compartment 112 and the integral tube 114 are in fluid communication.

The second sheet of material 102 is a web of plastic material that has properties that make it suitable for thermoforming. The material can be extruded or cast and can be composed of a monopolymer (e.g., polyethylene), a copolymer (e.g., a blend of resins such as polyethylene and ethylene vinyl acetate), a co-extrusion (a material composed of various resins, such as polyethylene, polypropylene, or nylon, which are extruded or cast as layers of a single web), or a laminate (a material composed of various resins such as polyethylene, polypropylene, or nylon, that are combined by adhering one sheet to another via adhesive lamination or extrusion lamination). The second sheet 102 can be transparent, translucent, or opaque depending on whether it is desired to permit a user to see the contents of the package or to protect the package contents from light. The second sheet 102 can also be of different gauges and the gauge can be selected to provide sufficient strength based on a number of different characteristics, such as the size of the package, the weight of the product to be contained in the package, and the environment in which the package is used (e.g., a high impact, high stress, heavy use environment would call for a heavier gauge). However, since the second sheet 102 is thermoformed into its final shape, it is stretched in certain areas in order to assume that shape as the sheet is drawn into the thermoforming apparatus (which is similar to a mold). This stretching results in a thinning of the material. In addition, due to the geometry of the final shape of the thermoformed compartment 112 and the integral tube 114, the second sheet 102 will be stretched in certain areas more than others. For example, the forming of the compartment 112 requires a deeper draw, so the second sheet 102 will be stretched more in this area in comparison to the area that corresponds to the integral tube 114 because the draw for forming the integral tube 114 is shallower. Thus, the second sheet 102 is of a first thickness on the roll, prior to thermoforming, and is thinner in areas in which the sheet is heavily deformed in order to assume its final shape. For example, in areas where there is a deep draw, a 5 mils thick sheet may stretch such that the final thickness after thermoforming is 3 mils. In other areas, where there is little to no drawing of the material, the thickness of the sheet does not change Accordingly, the gauge of the second sheet 102 has to be selected such that the portion of the sheet that undergoes the most stretching during thermoforming meets minimum thickness requirements in those areas. Other areas that do not experience as much stretching will exceed the minimum thickness requirements.

After the compartment 112 and integral tube 114 are formed, they are filled via a filling apparatus 206 with a liquid or semi-liquid product C. The product C can be a food product, such as a condiment (e.g., ketchup, mayonnaise, mustard, relish, honey, soy sauce, etc.), or it can be a non-food product (e.g., liquid floor cleanser).

The first sheet 104 is stored on and spooled off of a roll 208 and the first sheet 104 is disposed over the second sheet 102. Thus, the product C is contained between the first sheet 104 and second sheet 102. The first sheet 104 can be made from the same material and be the same gauge as second sheet 102. However, since first sheet 104 is not deformed during a thermoforming process it does not have to be as thick as the second sheet 102 because it does not undergo stretching that results in thinning of the material. Accordingly, the gauge of the first sheet 104 on the roll 208 can be of the minimum required thickness. This eliminates waste and reduces costs because a thinner gauge material can be selected for first sheet 104. The thickness of the first and second sheets can be selected in relation to one another such that deformed portions of the second sheet have a deformed thickness that is no less than approximately 70%-80% of the thickness of the first sheet and which is less than the thickness of the second sheet prior to deformation. Other ratios, such as 70%-90%, 60%-80%, 60%-90%, 50%-80%, and 50%-90% are contemplated. In addition, since the first sheet 104 does not undergo thermoforming, the material does not have to be suitable for thermoforming (i.e., it does not have to have characteristics suitable for heating and stretching to form the desired shape during the HFFS process). This allows for the selection of cheaper materials. In essence, the second sheet 102 is deformed to form the compartment 112 and the integral tube 114 and the first sheet 104 is a cover to seal and protect the product C in the compartment 112 and integral tube 114.

A heat sealing apparatus 210 is then applied to the first sheet 104 and the second sheet 102. The heat sealing apparatus 210 applies, for a duration, heat and pressure around the periphery of the package 100 sufficient to seal the first sheet 104 and second sheet 102. The first and second sheet are formed of plastic material such that the application of heat and pressure from the heat sealing apparatus 210 cause the sheets to bond together along a perimeter defined by the shape of the specially adapted heat sealing apparatus. Accordingly, the heat sealing apparatus 210 forms the seal 106 around the periphery of the package.

Figure 5:
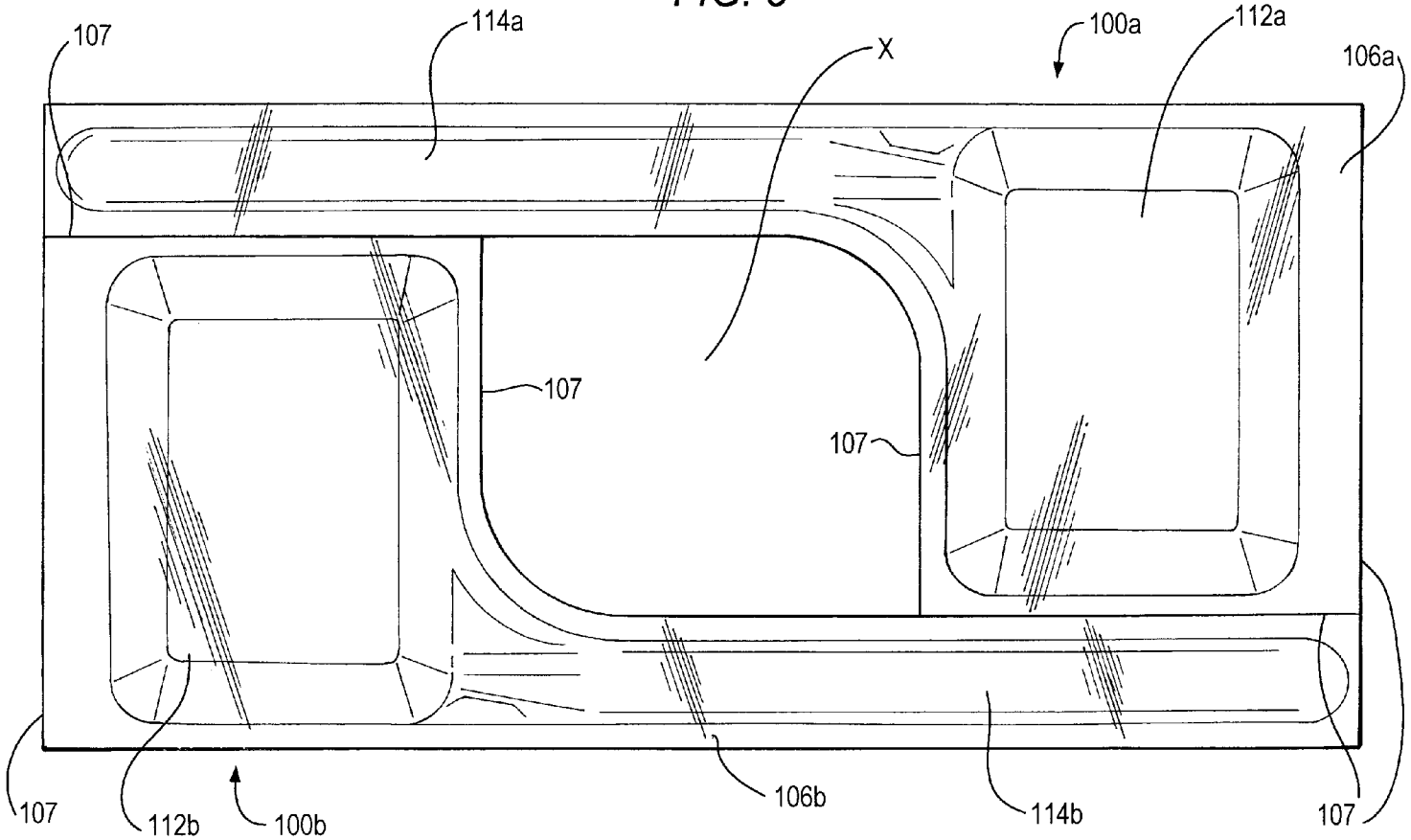
FIG. 5 is a top view of an arrangement of two side-by-side packages.

A cutting device 212 then cuts through the first sheet 104 and second sheet 102 along the seal 106 disposed between successive packages 100. Accordingly, a separate package 100 is formed containing product C. The first and second sheets 104, 102 that are sealed via seal 106 protect and preserve the product C that is disposed between the first and second sheets 104, 102. Accordingly, by using a HFFS process to form the packages 100 packages can be formed and filled in high volume at low cost. A cutting device can optionally place a notch 116 (see FIG. 2B) that increase the ease of tearing open the free end 118 (see FIG. 2B) on the integral tube 114 so that the product C can be dispensed therethrough. A laser score can also create a score line on the free end 118 of the integral tube 114 in order to facilitate opening Referring to FIG. 5, the HFFS process can be used to create two packages 100*a* and 100*b* at the same time while reducing the amount of waste material X. As can be seen in FIG. 5, by orienting the packages to face opposite ends and aligning them side-by-side, two packages 100*a* and 100*b* can be made using almost the same amount of first and second sheet 104, 102 material as would be used to create a single package. As can be seen, since the ends of the two packages align with each other, two packages can be created using the same length of sheet material that would be used to create a single package. Further, as can be seen in FIG. 5, the width of the sheet material needed to create two packages only needs to be increased by the amount necessary to accommodate an integral tube 114 side-by-side with a compartment 112. Integral tube 114*a* of package 100*a* is located along side compartment 112*b* of package 100*b* and integral tube 114*b* of package 100*b* is located along side compartment 112*a* of package 100*a*. Accordingly, by only increasing the width of the sheet materials of sheets 104 and 102 by a relatively small amount (i.e., the width necessary to accommodate the forming of an integral tube 114), two packages can be created while the amount of waste material X that is created is greatly reduced. This configuration, as shown in FIG. 5, greatly increases the efficiency of creating packages using the HFFS process.

In order to create two packages simultaneously, the size and shape of the thermoforming apparatus 204, which is similar to a mold, can be specially configured to accommodate the simultaneous forming of two packages, as shown in FIG. 5. The number and configuration of the filling apparatus 206 nozzles can be adjusted to accommodate filling of two packages simultaneously. In addition, the sealing apparatus 210 can be sized and configured to seal the packages 100*a* and 100*b* to create seals 106*a* and 106*b*, as shown in FIG. 5. The cutting apparatus 212, can also be sized and shaped to cut the packages along cut lines 107 so that the two packages 100*a* and 100*b* are separated from each other and separated from successive packages on the HFFS production line.

Figure 2A:
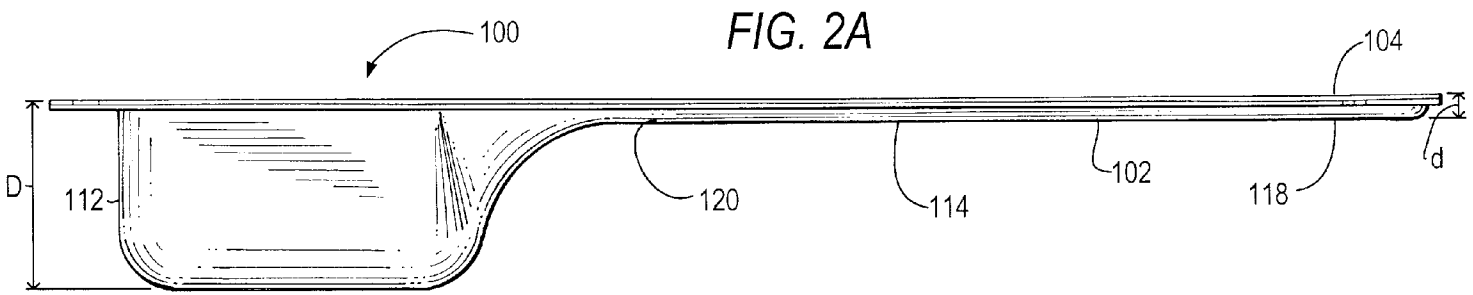
FIG. 2A is a side view of the package of FIG. 1.
Figure 2B:
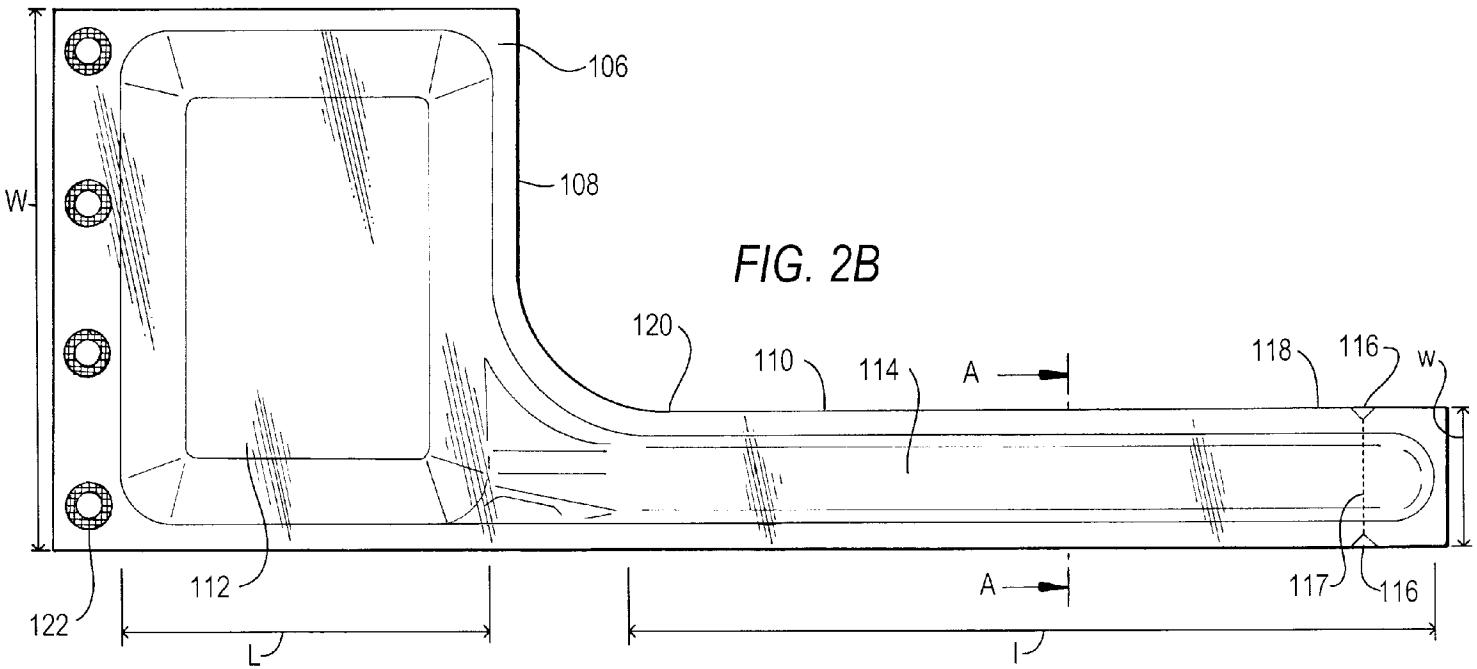
FIG. 2B is a top view of the package of FIG. 1.

Referring to FIGS. 1-3, in one illustrative example of use, the package 100 is intended for use in a quick serve restaurant and the product C contained in the package is a condiment (e.g., ketchup). The package 100 is shipped in box (not shown) and a user removes the package from the box. A rack with pegs is located in the restaurant in proximity to the food preparation area where the product C is needed. The package 100 includes mounting holes 122. The user mounts the package 100 on the rack by placing the pegs through the mounting holes 122 and the package 100 is suspended from the rack. The mounting holes 122 can be reinforced so that they are strong enough to support the package 100 suspending from the rack. Preferably, the package 100 is suspended above the food preparation area from the mounting holes 122 with the integral tube 114 extending downward so that gravity can be used to assist in dispensing of the product C from the package 100.

The free end 118 of the integral tube 114 is sealed during transportation and is opened when the package 100 is ready for use. Once the package 100 is ready for use, the user opens the free end 118 of the integral tube. The free end 118 can be opened by tearing the integral tube using notches 116 to create an opening 117 between the notches 116. If notches are not provided in the package, a user can use a scissor, knife, blade, or other such device to cut open the free end 118 of the package. Prior to opening the free end 118, the user can apply hand pressure to the integral tube 114 to pinch it shut in order to prevent unwanted dispensing of product from the package. The user could also use a clip or other device to close the integral tube 114 to prevent unwanted dispensing of the product during the opening of the free end 118. Once the free end 118 is opened, it can be inserted into the back end of a metering tool (e.g., a dispensing gun) (not shown) that holds the free end 118 in the tool and controls the amount of product dispensed every time a user manipulates the tool (press button or pull trigger) to dispense product. A spring clip can also be applied to the integral tube 114 that uses a spring that biases the clip closed thereby pinching closed the integral tube 114 and prevent the flow of product therethrough. When the user wants to dispense product (e.g., to fill a ketchup bottle or to apply product to a sandwich), the user can manipulate the clip to overcome the spring bias, thereby unpinching the integral tube 114 which allows the product to dispense through the free end 118 of the tube.

The integral tube 114 of the package 100 has a number of significant advantages over standard bulk containment pouches. Since the integral tube 114 is formed from the same sheet material as the compartment 112, there is no need for separate tubing. Tubing can be very expensive relative to the sheet materials used to form the compartment 112 and integral tube 114. Accordingly, elimination of tubing provides a significant advantage in terms of material costs. In addition, in order to connect tubing to a pouch, a separate fitment has to be installed into a pouch so that the tube can be inserted into the pouch. The integral tube design of the present package 100 does not require a fitment. This further eliminates the cost of the fitment itself and the cost of installing the fitment into the pouch. Accordingly, the package 100 offers significant advantages over the prior art.

While the invention has been described in connection with certain embodiments thereof, the invention is not limited to the described embodiments, but rather is more broadly defined by the recitations in any claims that follow and equivalents thereof.

What is claimed is:

1. A package for containing a flowable substance in a transport configuration and for dispensing the substance in a dispensing configuration, comprising:

a first sheet having a first thickness;

a second sheet disposed in opposing relation to the first sheet and having a second thickness, the second sheet having one or more deformed portions having a third thickness that is less than the second thickness;

a seal extending around a perimeter of the first and second sheets and defining first and second sections;

a compartment defined within the perimeter and between the first section of the first and second sheets, the compartment having a compartment length, a compartment width, and a compartment depth;

an integral dispensing tube defined by the second section, the integral tube having a first end in fluid communication with the compartment, and a second end that is closed in the transport configuration and that defines an opening in the dispensing configuration such that the substance contained in the package can flow from the container, through the integral dispensing tube, and exit the package via the opening, wherein the second end of the integral tube is positionable independent of the compartment.

2. The package of claim 1, wherein in a natural state the integral dispensing tube has a generally D-shaped cross-section in which the first sheet is generally flat.

3. The package of claim 1, wherein the third thickness is no less than approximately 70%-80% of the first thickness.

4. The package of claim 1, wherein the second end of the integral dispensing tube includes a plurality of tear notches, wherein a tear of the integral tube at a tear notch defines the dispensing opening.

5. The package of claim 1, wherein the seal is defined by regions of bonding together of the first and second sheets.

6. The package of claim 5, wherein the seal includes at least one mounting hole.

7. The package of claim 6, wherein the at least one mounting hole is positioned such that the package can be supported from the at least one mounting hole with the integral dispensing tube extending downwardly from the compartment.

8. The package of claim 7, wherein the force of gravity assists the substance contained in the package to flow from the container, through the integral dispensing tube, and exit the package via the dispensing opening when the package is suspended with the integral dispensing tube extending generally downwardly from the compartment.

9. The package of claim 6 which includes two spaced-apart mounting holes located adjacent a perimeter seal opposite the integral dispensing tube.

10. The package of claim 1 in which the thickness of the first sheet is less than the second thickness of the second sheet.

* * * * *